United States Patent [19]

Cerroni

[11] 4,314,674

[45] Feb. 9, 1982

[54] PROCESS FOR SEPARATING THE PAPER FROM THE PLASTIC EXISTING IN THE URBAN SOLID WASTE

[76] Inventor: Manlio Cerroni, Via Bruxelles, 53 Roma, Italy

[21] Appl. No.: 205,897

[22] Filed: Nov. 12, 1980

Related U.S. Application Data

[63] Continuation of Ser. No. 52,457, Jun. 27, 1979, abandoned.

[30] Foreign Application Priority Data

Jul. 10, 1978 [IT] Italy ..... 50220 A/78

[51] Int. Cl.[3] ..... B02C 19/12

[52] U.S. Cl. ..... 241/14; 241/24; 241/DIG. 38

[58] Field of Search ..... 241/24, 14, DIG. 38, 241/30

[56] References Cited

U.S. PATENT DOCUMENTS

| | | | |
|---|---|---|---|
| 3,154,255 | 10/1964 | Schulman et al. | 241/14 |
| 4,000,031 | 12/1976 | Acobas | 241/14 X |
| 4,020,992 | 5/1977 | Binger et al. | 241/14 X |

*Primary Examiner*—Mark Rosenbaum

*Attorney, Agent, or Firm*—Silverman, Cass & Singer, Ltd.

[57] ABSTRACT

A process for separating an urban waste mixture of paper and plastic film into its primary components comprising partially triturating the mixture to reduce the paper components to a small particle size ground condition while the plastic film component is generally unchanged and separating the unchanged component from the partially triturated mixture by combing same therefrom.

3 Claims, 1 Drawing Figure

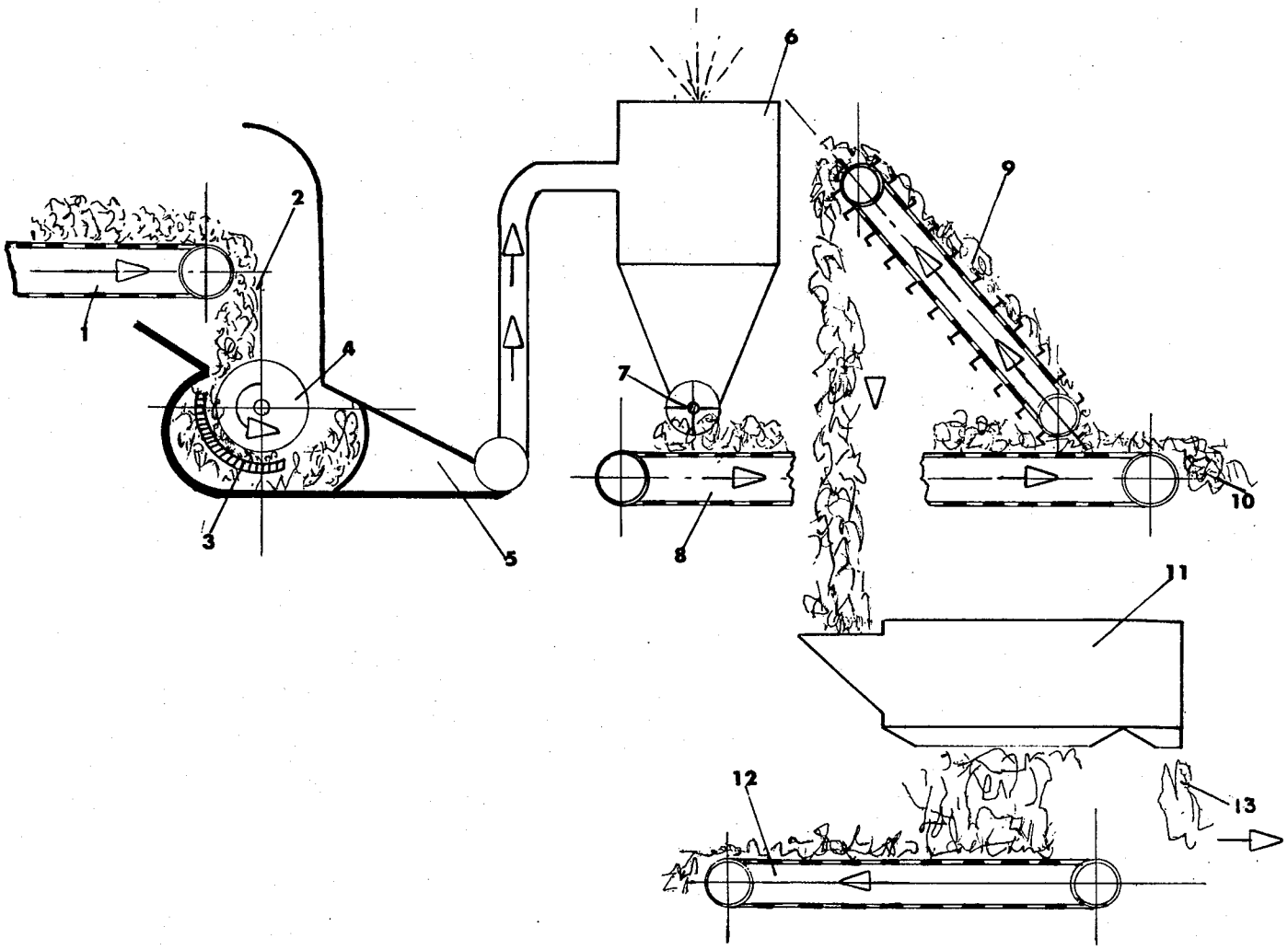
1
2
3
4
5
6
7
8
9
10
11
12
13

PROCESS FOR SEPARATING THE PAPER FROM THE PLASTIC EXISTING IN THE URBAN SOLID WASTE

This is a continuation of application Ser. No. 052,457 Filed June 27, 1979 now abandoned.

BACKGROUND OF THE INVENTION

It is known that, at present, both town management boards and state and super-national authorities are actively working in order to fight waste and pollution. Among the campaigns which have been started and summoned for these reasons, the recommendation is to be particularly pointed out by these authorities that the incineration of urban solid waste should be stopped and thei re-utilization should be attempted by the extraction, from said waste, of those materials which may in some way be still re-utilized.

Among the most interesting recoverable materials, paper and plastic can be mentioned, whose recovery may lead to achieve remarkable economies.

A big hindrance to the recovery of paper from urban solid waste is just caused by the presence of the plastic films, unavoidable presence unfortunately, which damages or, in any case, renders extremely difficult the obtaining of a recovery paper able to be sufficiently re-utilized in the industries. On the other hand, plastic film per se is, by reason of its characteristics, a re-utilization product and of remarkable industrial interest, too.

SUMMARY OF THE INVENTION

An object of the present invention is a process to separate paper from plastic film, and in particular to separate these two materials when contained within the urban solid waste. According to the mentioned process, it is necessary to start from an already previously selected product originating from one or more treatment stations, in order to get at disposal a product which altogether is substantially composed by paper and plastic film.

As opposed to the presently known processes, the process which we are mentioning is substantially effected in an automatic way, and employs equipments which are per se known, even if not all of them belong to the specific field in which their are utilized in the present invention.

The process according to the invention consists essentially in withdrawing a mix of paper and plastic film arriving from a previous separation and introducing this mixture into a triturating or grinding device, within which the mixture itself undergoes a partial trituration. To this end, the triturator, which is of a type per se known, has a shut grid, so that the material entering the triturator is subsequently expelled according to different sizes, which are not necessarily particularly fine.

In this so modified triturating device, the paper, which, as known, has a lesser stretching capacity, is reduced into minute pieces, while the plastic film keeps its original size almost unchanged.

According to one embodiment of the invention the partially triturated mixture consisting of triturated paper and plastic film of generally large size is transported to a decantation cyclone from which same is discharged to a conveyor.

The conveyor is led past a separating machine which combs the mixture to separate the plastic film from the ground paper. The plastic film is then discharged to a screen, any residual paper pieces passing therethrough while the plastic film is retained by the screen.

The separating machine, which is of the type described in the Italian patent no. 49707 A/77 and no. 49389 A/78, filed by "Sorain Cecchini S.p.A." of Rome, is a particularly useful and versatile machine which, owing to its conformation or structure, permits the separation of the paper from the plastic film mixture which by exploiting the different comprises relatively non-elastic small particles of paper and elastic large pieces of plastic film. Advantage is taken of the diametrically opposed elastic properties of the two components by subjecting the triturated mixture to a combing separator apparatus. The teeth, or hooks, of the combing member readily engage the plastic film, without stretching it beyond its elastic limit, thereby affecting separation of substantially all of the plastic film from the paper particles. Since a minor proportion of paper particles adhere to, or are entrapped within the separated plastic film, the "plastic film" stream discharging from the combing apparatus is discharged into a second separator of the screen type. The preferred screen is of the rotary type and receives all the material hooked by the rotor comprising primarily plastic film with a portion of paper. This material is divided into two portions within the screen separator, namely material which passes through the screen and is composed of a small amount of reduced size paper which may have adhered to the plastic film when the latter was hooked by the rotor and a substantially larger fraction of the mixture discharged to the screen separator which is retained by the screen and comprises primarily plastic film with extremely small traces of paper. This fraction is recovered in condition for reutilization of the plastic.

As it can be noticed, the described process is a particularly interesting process since it enables, the utilization of existing machinery for the separation of the paper from the plastic film, starting from a mixture of these two materials, and it enables the reutilization of the paper in a form substantially free from polluting agents such as plastic film while also enabling the re-utilization of the plastic film without the presence of polluting substances, such as paper. The re-utilization of these two products is of a particular interest just because they are materials having an elevated economic value.

As it has been said previously, the triturator effects the trituration of the mixture entering into it only for a portion of its rotation, since the discharge therefrom it receives only material passing through a portion of the triturating grid of the triturator. This is so because one wants to obtain a trituration of the entering mixture within a determined degree of trituration or grinding, but the whole material entering the triturator must be successively treated for the separation of the paper from the plastic film.

BRIEF DESCRIPTION OF THE DRAWING

The single FIGURE is a schematic flow representation of the process according to the invention.

DETAILED DESCRIPTION OF THE INVENTION

With reference to the drawing, the mixture consisting primarily of paper and plastic film which has been previously separated from urban waste is conveyed by a conveying band 1, is made to fall into a triturating device 2, within which said mixture undergoes a partial trituration. In one example, the grid 3 of the triturating device 2 will encompass an arc of 60–120 degrees of the rotor 4 of the triturator so as to achieve a trituration of the rigid paper portion of the mixture and a preservation of the more flexible and elastic portion of the misture which is primarily the plastic film. The ground (partially triturated) mixture is transferred to a cyclone 6 by way of pneumatic conveyor 5, and passes through the star valve 7 of the cyclone for discharge, onto a conveyor 8. The separation of the paper from the plastic film is effected by combining the partially triturated mixture using rotor 9. The ground paper remains on the conveying band 8 and is discharged therefrom at 10 and thereafter, forwarded for re-utilization. This ground paper contains only slight traces of plastic material. The plastic film is hooked by the rotor 9 and is discharged into a rotating screen 11. The material which passes through the screen is substantially composed by plastic and paper, both reduced into extremely small pieces and is discharged onto a conveyor reach 14 of endless band 12. The thus discharged material on reach 14 conveyed to a waste disposal site (not shown) while the retained portion on screen, consisting primarily of plastic film with extremely small impurities formed by paper directed through the outlet 13 to a paper re-utilization location (not shown).

The above described process may be modified by directly discharging the partially triturated mixture onto conveyor 8 where same is combed by hooked rotor 9 to separate the primary components.

The process according to the invention has been illustrated and described in its general guidelines, always keeping in mind what has been previously said that is that the needed apparatuses for the realization of the process comprise apparatus which may be known per se but which have not been employed or suggested as capable being employed to recover separated plastic and paper fractions from a mixture primarily of such materials obtained from urban waste.

For the purpose of this application and the claiming of the process of this invention, the term "combing" is intended to represent the step of passing rotor 9 through the mixture received either from star valve 7 or direct from the triturator 2 onto belt 8. Also, triturating is intended to represent the act of grinding, and triturator is a grinding machine.

Optional additions or modifications or variations of the abovedescribed process will be within the scope of the present invention as defined in the appended claims.

I claim:

1. A substantially dry process for separating a waste mixture comprising relatively large size pieces of paper and plastic film into its primary components for recycle, said process comprising the steps of:

triturating said mixture under conditions wherein the paper component is reduced to small particles while the plastic film remains substantially unchanged in size so as to provide differentially triturated waste;

subjecting the differentially triturated waste to a combing separation to recover the paper and plastic film as generally separate components; and subjecting the recovered plastic film component to a screening separation to recover a substantially small paper particle-free plastic film component and a substantially plastic film-free small paper particle component.

2. The process as claimed in claim 1 in which the differentially triturated mixture is directed to a conveying means and carried thereon to a separating station, the mixture being combed to separate the flexible unchanged plastic film components from the mixture.

3. The process as claimed in claim 1 in which the differentially triturated mixture is pneumatically directed to a cyclone separator and discharged to a conveyor, the mixture being flowed along the conveyor and combed to remove the plastic film therefrom, the removed plastic film then is screened.

* * * * *